US008894350B2

(12) United States Patent
Brunner et al.

(10) Patent No.: US 8,894,350 B2
(45) Date of Patent: Nov. 25, 2014

(54) REDUCED PROFILE ABRASION RESISTANT PUMP THRUST BEARING

(75) Inventors: Christopher M. Brunner, Owasso, OK (US); David W. Chilcoat, Jenks, OK (US); Jason B. Ives, Broken Arrow, OK (US)

(73) Assignee: Baker Hughes Incorporated, Houston, TX (US)

( * ) Notice: Subject to any disclaimer, the term of this patent is extended or adjusted under 35 U.S.C. 154(b) by 1059 days.

(21) Appl. No.: 12/938,160

(22) Filed: Nov. 2, 2010

(65) Prior Publication Data

US 2012/0107114 A1 May 3, 2012

(51) Int. Cl.
*F04D 1/06* (2006.01)
*F04D 29/041* (2006.01)

(52) U.S. Cl.
CPC ..... *F04D 29/041* (2013.01); *Y10S 415/901* (2013.01)
USPC ..... 415/107; 415/229; 415/901

(58) Field of Classification Search
CPC ..... F04D 1/06; F04D 1/063; F04D 29/041; F04D 29/0413; F05B 2240/52
USPC ..... 415/104, 107, 229, 901; 384/97, 105, 384/129, 275, 368–369, 420, 193–194
See application file for complete search history.

(56) References Cited

U.S. PATENT DOCUMENTS

| | | | | | |
|---|---|---|---|---|---|
| 3,709,573 | A * | 1/1973 | Orkin et al. | ..... | 384/264 |
| 3,802,803 | A | 4/1974 | Bogdanov | | |
| 4,728,201 | A | 3/1988 | Abbe | | |
| 4,872,808 | A * | 10/1989 | Wilson | ..... | 415/170.1 |
| 5,033,937 | A | 7/1991 | Wilson | | |
| 5,265,965 | A * | 11/1993 | Harris et al. | ..... | 384/208 |
| 5,722,812 | A * | 3/1998 | Knox et al. | ..... | 415/199.1 |
| 5,765,950 | A | 6/1998 | Eno | | |
| 6,068,444 | A | 5/2000 | Sheth | | |
| 6,899,517 | B2 * | 5/2005 | Gay et al. | ..... | 415/104 |
| 7,575,413 | B2 | 8/2009 | Semple | | |
| RE43,363 | E * | 5/2012 | Semple et al. | ..... | 415/107 |
| 2009/0267435 | A1 | 10/2009 | Appel | | |

FOREIGN PATENT DOCUMENTS

| | | |
|---|---|---|
| GB | 234546 | 5/1925 |

* cited by examiner

*Primary Examiner* — Edward Look
*Assistant Examiner* — Jesse Prager
(74) *Attorney, Agent, or Firm* — Bracewell & Giuliani LLP

(57) ABSTRACT

A centrifugal pump has a stationary diffuser with a bore. A thrust bearing is pressed into the diffuser bore and has a curved interior. A thrust runner having a curved exterior is correspondingly and closely received by the thrust bearing interior. The thrust runner is keyed to a shaft and transmits thrust from a rotating impeller to the diffuser via the thrust bearing. The curved surface of the thrust bearing allows for handling of both axial and radial thrust without the need for multiple thrust bearings. The increased surface area of the curved surface in the thrust bearing can also handle higher loads.

19 Claims, 6 Drawing Sheets

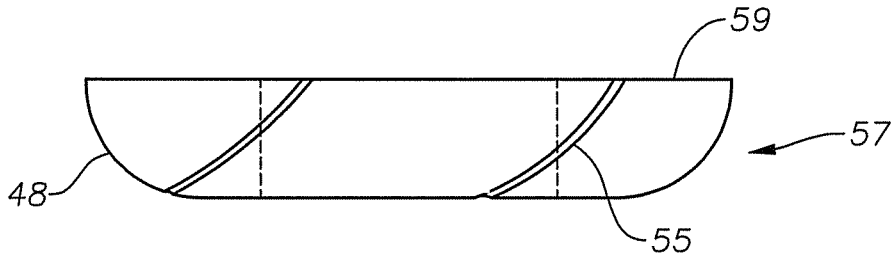
Fig. 4
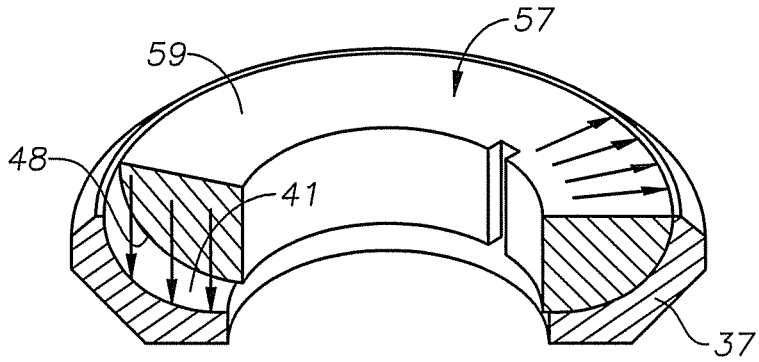
Fig. 5
Fig. 6
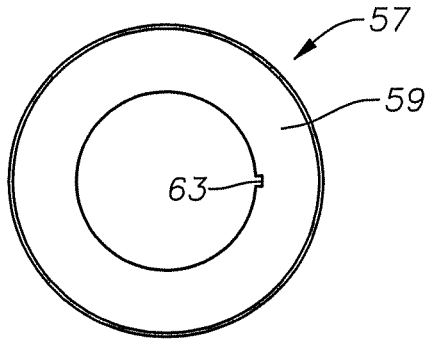

REDUCED PROFILE ABRASION RESISTANT PUMP THRUST BEARING

FIELD OF INVENTION

This invention relates in general to electrical submersible well pumps and in particular to thrust bearings for a centrifugal pump.

BACKGROUND OF THE INVENTION

Centrifugal well pumps are commonly used for pumping oil and water from oil wells. The pumps have a large number of stages, each stage having a stationary diffuser and a rotating impeller. The rotating impellers exert a downward thrust as the fluid moves upward. Also, particularly at startup and when the fluid flow is nonuniform, the impellers may exert upward thrust. In a common pump design, the impellers float freely on the shaft so that each impeller transfers downward thrust to one of the diffusers. A thrust washer, sleeve, or bearing is located between a portion of each impeller and the upstream diffuser to accommodate the downward thrust. Another thrust washer transfers upward thrust.

Some wells produce abrasive materials, such as sand, along with the oil and water. The abrasive material causes wear of the pump components, particularly in the areas where downward thrust and upward thrust are transferred. Tungsten carbide thrust bearings and bearing sleeves along with shaping of components may be employed in these pumps to reduce wear. A number of designs for these components exist, but improvements are desirable.

SUMMARY OF THE INVENTION

The centrifugal pump stage of this invention has a stationary diffuser having a bore. A thrust bearing has a tubular portion that inserts into the bore of the diffuser. A generally cylindrical base or shoulder extends radially outward and bears against a support surface formed in the bore of the diffuser for transmitting downward thrust from an upstream impeller to the diffuser. In addition, a tapered shoulder extends from the external shoulder and bears against a correspondingly tapered support surface formed on the diffuser for transmitting thrust radially from the impeller to the diffuser.

A thrust runner rotatably engages a curved interior surface on a downstream end of the thrust bearing for transmitting the downward axial thrust from the downstream impeller to the diffuser via a sleeve in contact with both the impeller and the thrust runner. The thrust runner and thrust bearing may also be considered collectively as a bearing. The thrust runner has an upstream curved end that corresponds with the interior surface of the thrust bearing, resulting in a greater surface area on the upstream end than on a downstream end. The curved upstream end of the thrust runner transmits thrust radially to the bearing. Further, the greater surface area between the curved interior surface of the thrust bearing and the corresponding curved upstream end of the thrust runner allow for handling of higher loads. The thrust bearing, sleeve, and thrust bearing are preferably constructed of hard wear resistant materials, such as tungsten carbide.

BRIEF DESCRIPTION OF THE DRAWINGS

FIG. 4 is a side view of a thrust runner of the pump stage of FIG. 2, shown removed from the pump.

FIG. 5 is a perspective sectional view of a thrust bearing and runner of the pump stage of FIG. 2, shown removed from the pump.

FIG. 6 is a top view of the thrust runner of FIG. 2.

DETAILED DESCRIPTION OF THE INVENTION

Figure 1:
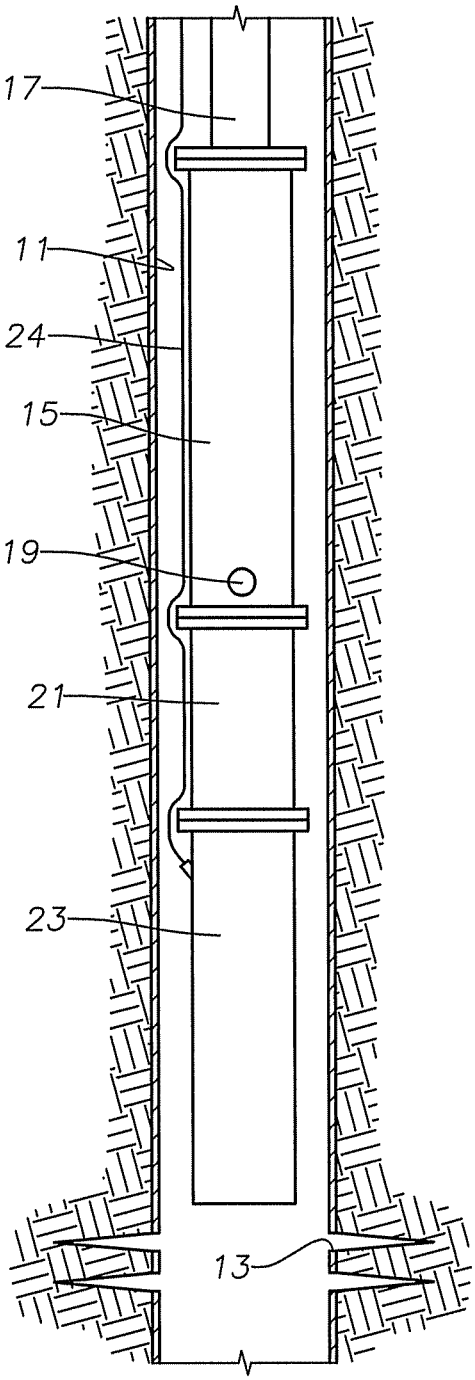
FIG. 1 is a schematic elevational view of a pump in accordance with this invention and shown within a well.

Referring to FIG. 1, a pump assembly is shown in a well having a casing 11. Perforations 13 within casing 11 allow well fluid to flow into the casing 11. An electrical submersible pump ("ESP") 15 is shown suspended in the well on a string of production tubing 17. Pump 15 has an intake 19 for drawing in well fluid and pumping it through tubing 17 to the surface. Alternately, in some instances pump 15 will discharge into casing 11 above a packer (not shown).

Pump 15 has a seal section 21 connected to its lower end. An electrical motor 23 connects to the lower end of seal section 21. Seal section 21 reduces a pressure differential between lubricant within motor 23 and the hydrostatic pressure in the well. An electrical power cable 24 extends downward from the surface to motor 23 for supplying power.

Figure 2:
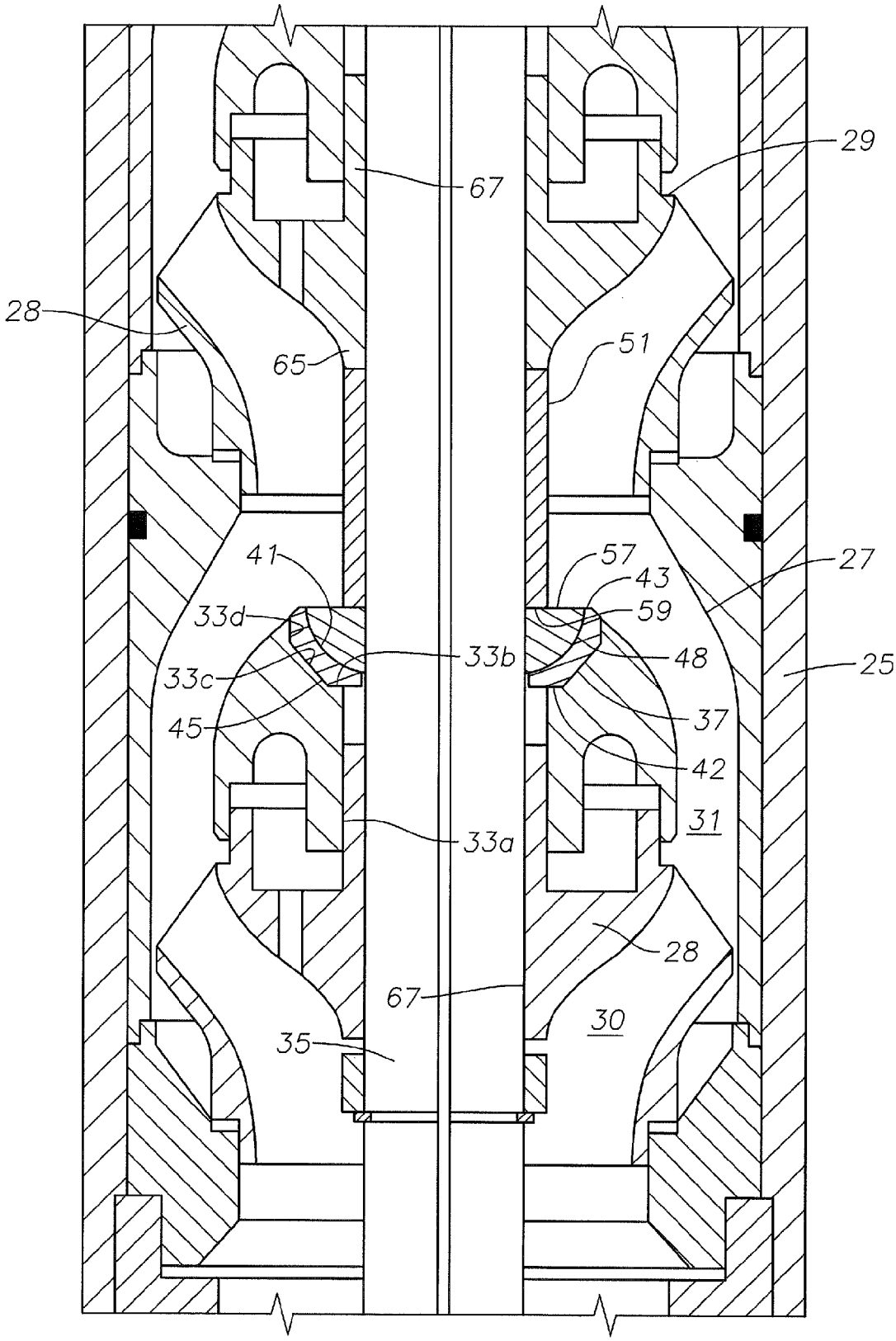
FIG. 2 is a sectional view of a stage of a pump constructed in accordance with this invention.

Referring to FIG. 2, a stage of pump 15 (FIG. 1) is illustrated in this embodiment. However, pump 15 is a centrifugal pump and will include a plurality of stages. Each stage has a diffuser 27, and an upstream impeller 28. Diffuser 27 discharges into a downstream impeller 29. Each impeller 28, 29 rotates and has passages 30 that lead upward and outward from a lower inlet. Diffusers 27 stack on top of each other within a cylindrical housing 25. Diffusers 27 are non-rotatable relative to housing 25. Each diffuser 27 has a plurality of passages 31 that extend from a lower or upstream inlet to an upper or downstream outlet. The inlet is farther radially from a longitudinal axis of pump 15 than the outlet. In this embodiment, the stages are a mixed flow type, wherein passages 30, 31 extend both radially and axially. This invention is applicable also to radial flow types, wherein the passages of the stages are primarily radial.

Diffuser 27 has an axial bore with a lower portion 33*a*, an upward facing shoulder or support surface 33*b*, a tapered shoulder or support surface 33*c*, and an upper portion 33*d*. The terms "upper" and "lower" are used herein for convenience only and not in a limiting manner. Lower portion 33*a* has the smallest diameter, while the tapered shoulder 33*c* is recessed radially outward by an amount defined by the upward facing shoulder 33*b*. The tapered shoulder 33*c* slopes radially upward to meet the upper portion 33*d*, which is cylindrical and has the largest diameter of the bore. In this embodiment, lower portion 33*a* has a greater length than either of the shoulders 33*b*, 33*c*, or 33*d*. The various portions 33*b*, 33*c* and 33*d* form a generally concave shape.

Continuing to refer to FIG. 2, in this embodiment, a shaft 35 extends rotatably through diffuser bore portions 33*a*, 33*b*, 33*c* and 33*d* for rotating impellers 28, 29. A thrust bearing base 37 is non-rotatably mounted in portions 33*b*, 33*c*, and 33*d* of the diffuser bore, such as by an interference fit or other means. Thrust bearing base 37 may be a generally bowl-shaped member having a generally cylindrical bottom or shoulder 42 at an upstream side that extends radially outward. Bottom shoulder 42 at least partially bears against the upward facing shoulder 33*b* formed in the bore of the diffuser 27 to transmit downward thrust from the upstream impeller 29 to the diffuser 27. Further, a tapered exterior shoulder 45 on thrust bearing base 37 extends upward bottom shoulder 42 and bears against the corresponding tapered support shoulder 33*c* formed on the diffuser 27 to thereby transmit thrust from the downstream impeller 29 to the diffuser 27. The outer diameter of bottom shoulder 42 is less than the outer diameter of the upper portion 33*d* of the bore, defining the lower end of tapered shoulder 45 of the thrust bearing base 37. The upper end of tapered shoulder 45 joins a cylindrical surface on thrust bearing base 37. The cylindrical surface mates with surfaces 33*d* in diffuser 27. The lower side of thrust bearing base 37 is thus generally convex and thus conforms to the upper side portions, 33*b*, 33*c* and 33*d*, of diffuser 27. Although the lower side of thrust bearing base 37 is generally convex and the mating upper side of diffuser 28 generally concave, other shapes are feasible. The bearing base 37 is suitably bonded to diffuser 28.

The upper or downstream side 43 of thrust bearing base 37 terminates substantially flush with the outlet of passages 31. A generally concave thrust face 41 is formed on the downstream or upper side of thrust bearing base 37, with a curvature extending from an inner diameter of the thrust bearing base 37 to a rim 43 at the downstream end of the thrust bearing base 37. Concave thrust face 41 is shaped similar to the lower side portions 42, 45 of thrust bearing base 37 providing a substantially uniform thickness for thrust bearing base 37. In this embodiment, concave thrust face 41 is a portion of a sphere.

Figure 3:
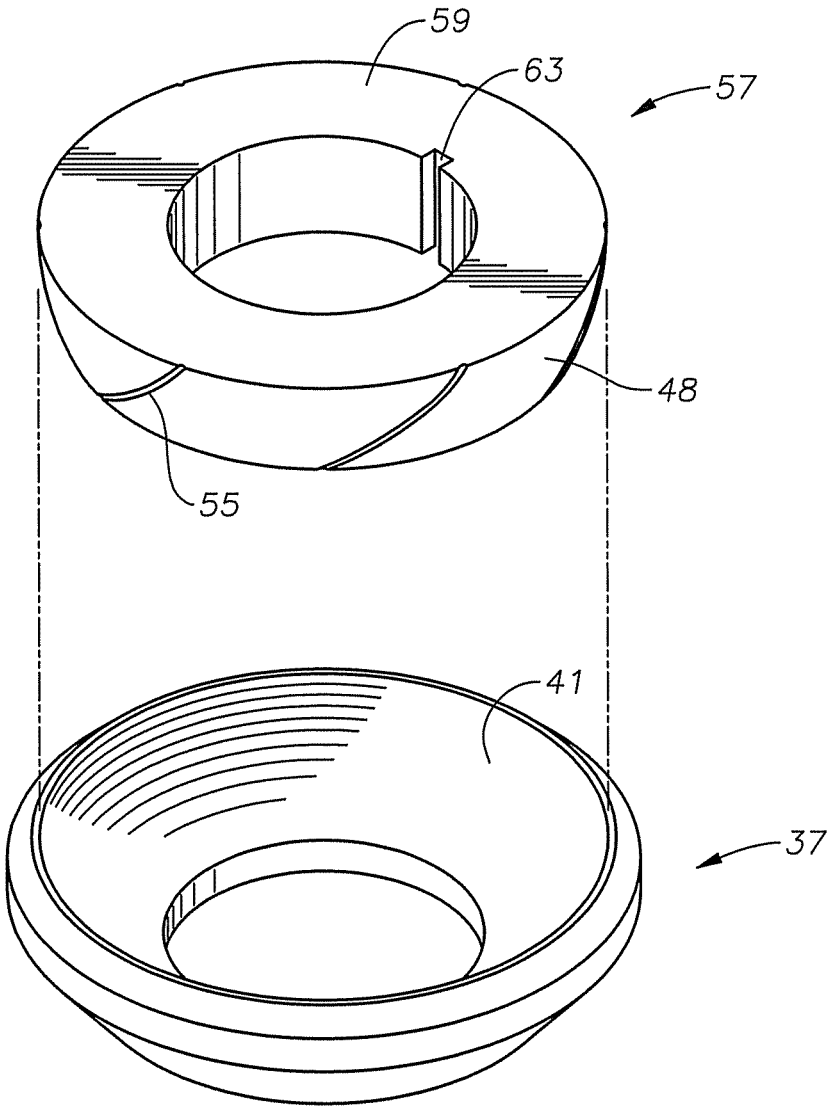
FIG. 3 is a perspective view of a thrust bearing and runner of the pump stage of FIG. 2, shown removed from the pump.

In this embodiment a thrust runner 57 has an upstream or lower convex end 48 that mates with and rotatably engages the corresponding, concave thrust face 41 of the thrust bearing base 37, as shown in FIG. 3. The thrust runner 57 transmits downward axial thrust from the downstream impeller 29 to the diffuser 27 via a sleeve 51 in contact with both impeller 29 and thrust runner 57. Sleeve 51 may have a cylindrical flat lower end 59 that is in contact with a downstream side 59 of the thrust runner 57.

A downward extending impeller hub 65 of the adjacent downstream impeller 29 or a spacer (not shown) if used, contacts the upper end of sleeve 51. The adjacent upstream impeller 28 has an upward extending hub 67 that fits in an annular space defined by the lower bore portion 33*a* and a portion of thrust bearing base 37. The upper end of hub 67 does not contact thrust bearing base shoulder 42. Sleeve 51 and thrust runner 57 are keyed to the shaft 35 to cause sleeve 51 and thrust runner 57 to rotate with shaft 35. Sleeve 51 and thrust runner 57 are free to move axially on shaft 35 a limited distance that is defined by axial movement of the downstream impeller 29. In this embodiment, the axial length of sleeve 51 is more than the axial length of the thrust bearing base 37. Sleeve 51 and thrust runner 57 could be integrally joined to each other.

The convex and concave surfaces 48, 41 of the thrust runner 57 and the thrust bearing base 37, respectively, provide a greater surface area for handling larger axial loads than a flat surface. As shown in FIG. 5, downward thrust transmitted to thrust bearing base 37 has an outward or radial component because of the concave/convex curvature of the mating surface of thrust runner 57 and thrust bearing base 37. The surface area of the convex upstream side 48 of the thrust runner 57 is substantially the same as the surface area of the concave thrust face 41 of thrust bearing base 37. As shown in FIGS. 3 and 4, spiral or helical grooves 55 may be formed on convex side 48 of thrust runner 57. Grooves 55 facilitate the introduction of lubricant between the thrust runner 57 and the thrust bearing base 37. Grooves 55 may be parallel to each other and curve from the lower to upper side of thrust runner 57. Alternately, grooves 55 could be formed in concave face 41 of thrust bearing base 37. In this embodiment, an internal key slot 63 (FIGS. 5 and 6) in thrust runner 57 receives a key (not shown) on the shaft 35 to cause rotation of thrust runner 57.

Thrust bearing base 37, sleeve 51 and thrust runner 57 may be constructed of a harder and more wear resistant material than the material of diffusers 27 and impellers 28, 29. In a preferred embodiment, the material comprises a carbide, such as tungsten carbide. Tungsten carbide provides better abrasion resistance against abrasive materials such as sand than the material of diffuser 27 and impeller 28, 29.

In operation, motor 23 (FIG. 1) rotates shaft 35 (FIG. 2), which in turn causes impellers 28, 29, thrust runner 57 and sleeve 51 to rotate. The rotation of impellers 28, 29 causes fluid to flow through impeller passages 30 and diffuser passages 31. The fluid pressure of the flowing fluid increases with each pump stage. Impellers 28, 29 are keyed to shaft 35 for rotation, but not fixed to shaft 35 axially. Downward axial thrust exerted by the pumping action is applied by each impeller 28, 29. The lower end of hub 65 of the downstream impeller 29 transmits the axial thrust through rotating thrust runner 57 into the stationary thrust bearing base 37. The axial thrust and a radial component transfers through diffuser 27 to the diffuser (not shown) located below it, and eventually to the lower end of pump housing 25.

Under some circumstances, up thrust occurs, causing hub 67 of upstream impeller 28 to move upward into contact with an upstream facing shoulder on the lower portion 33*a* of the diffuser 27. The upward force transfers from the diffuser 27 and into housing 25.

Figure 7:
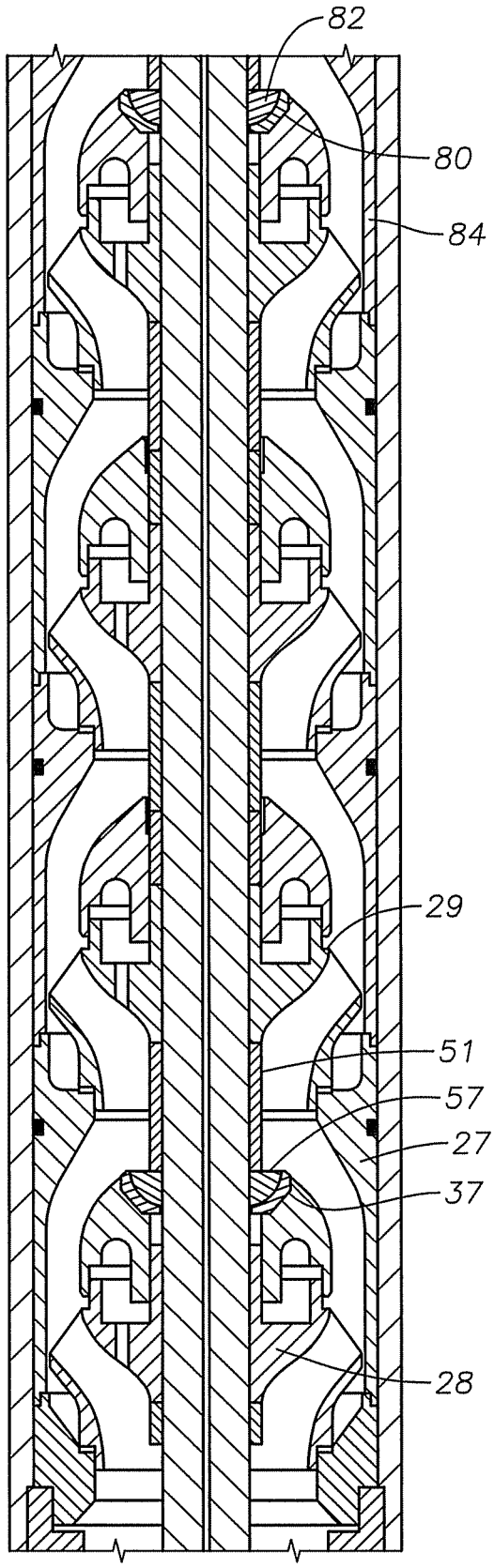
FIG. 7 is a sectional view of another embodiment of a stage of a pump constructed in accordance with this invention.

If desired, each stage could have one of the thrust bearing bases 37, thrust runners 57, and sleeve 51. Alternately, as shown in FIG. 7 some of the stages could be of conventional type, not having a thrust runner, thrust bearing, or sleeve as described. Spacer sleeves 69 are located between the impeller hubs 57 of these conventional stages and thrust sleeves 51 to the next stage having a thrust runner 57 and thrust bearing base 37 as described. A thrust runner 57 and thrust bearing base 37 arrangement identical to that described previously is installed within one of the stages. An additional thrust bearing base 80 and a thrust runner 82 is located within a diffuser 84 located downstream of the upstream thrust 57 runner and bearing base 37. Two conventional stages 71, 73 are located between thrust bearing base 80 and thrust bearing base 37. Downward thrust from the stage 71 passes through its thrust sleeve 51 and spacer 69 to stage 73. The thrust is passed from stages 73 through hub 67 to thrust sleeve 51, thrust runner 57 and thrust bearing base 37 to the associated diffuser 27. This arrangement provides additional thrust handling capacity in the ESP 15.

Figure 8:
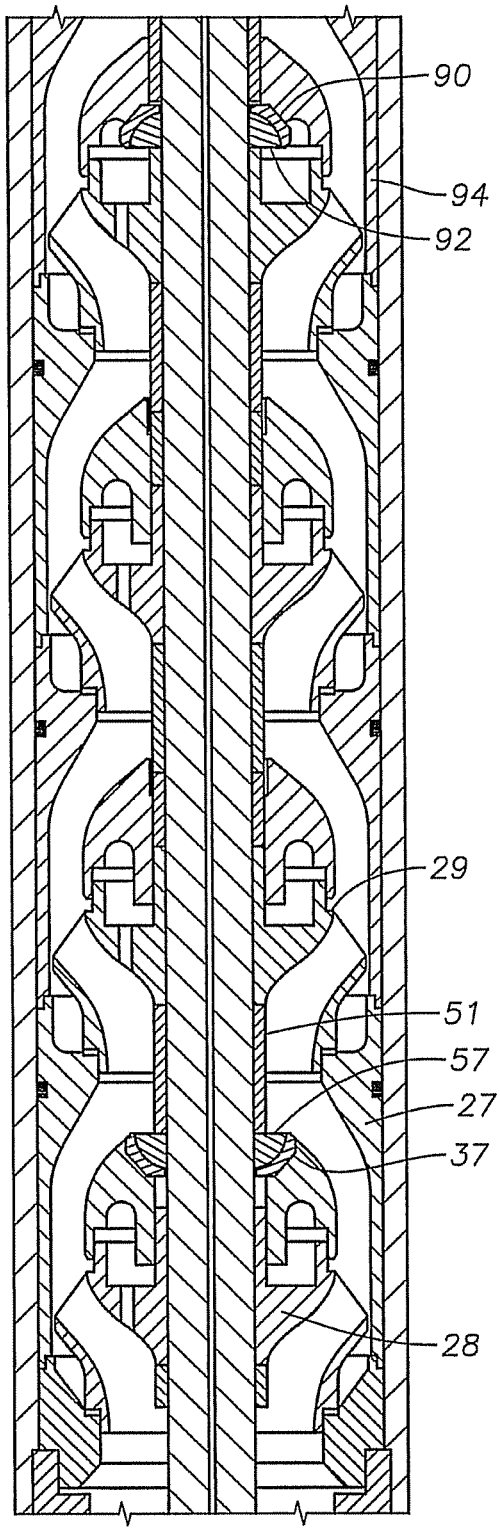
FIG. 8 is a sectional view of another embodiment of a stage of a pump constructed in accordance with this invention.

In yet another embodiment illustrated in FIG. 8, opposite-facing thrust bearing and runner arrangements are shown. The upstream thrust bearing base and runner 37, 57 handling down thrust is identical to a previously discussed embodiment and transfers the down thrust to the diffuser 27. A downstream thrust bearing base 90 is installed within a downward-facing side of diffuser 94, and an up thrust runner 92 rotatably engages thrust bearing base 90. The downstream arrangement is identical to the upstream arrangement, however the downstream thrust bearing base 90 and thrust runner 92 are installed in a direction that faces the upstream arrangement and handles up thrust. An upper end of the hub 67 of the adjacent impeller 28 abuts the lower side of thrust runner 92 to transfer upward thrust. The arrangement described in this embodiment, may thus handle either up thrust or down thrust. In addition, if either thrust runner becomes disengaged from a thrust bearing, the other engaged thrust runner will still be capable of handling thrust. In the embodiment of FIG. 8, spacer 69 transmit both down thrust and up thrust between hubs 67 and thrust runner 51.

The invention has significant advantages. The thrust bearing provides transfers both thrust axial and radial component to the diffuser. The thrust bearing base and runner also provide radial support for the shaft. The thrust faces are considerably larger in cross-sectional area than flat face due to the curved surfaces employed. More thrust can be handled in less height because individual bearings for handling radial loads are not required. The decrease in parts also lowers cost and increases reliability.

While the invention has been shown in only one of its forms, it should be apparent to those skilled in the art that it is not so limited but is susceptible o various changes without departing from the scope of the invention.

We claim:

1. A centrifugal pump comprising:

a rotatably driven drive shaft;

a diffuser having a bore through which the shaft passes, the diffuser having a generally concave receptacle surrounding the bore of the diffuser;

a thrust bearing base having a generally convex side bonded to the receptacle of the diffuser, the thrust bearing base having a generally concave thrust face;

a thrust runner having a generally convex side in rotating engagement with the thrust face of the thrust bearing base, the thrust runner being axially movable relative to the shaft and rotatable with the shaft;

a downstream impeller rotated by the shaft downstream of the diffuser;

a thrust sleeve surrounding and rotatable with the shaft and extending between the downstream impeller and the thrust runner for transmitting down thrust to the thrust bearing base; and wherein the thrust sleeve, the thrust runner, and the thrust bearing base are made of a harder material than the diffuser and the downstream impeller.

2. The centrifugal pump according to claim 1, wherein the receptacle of the diffuser comprises:

a flat shoulder, a conical surface extending outward from the shoulder, and a cylindrical surface joining and extending from the conical surface.

3. The centrifugal pump according to claim 2, wherein the thrust face of the thrust bearing base is spherical.

4. The centrifugal pump according to claim 1, wherein the thrust sleeve, the thrust runner, and the thrust bearing base are made of tungsten carbide.

5. The centrifugal pump according to claim 1, further comprising:

an upstream impeller rotated by the shaft in engagement with an upstream side of the diffuser, the upstream impeller having a hub through which the shaft passes; and wherein the thrust bearing base has an inner portion spaced from the hub of the upstream impeller by a gap.

6. The centrifugal pump according to claim 1, wherein:

the thrust runner has a flat side; and the thrust sleeve has an end that abuts the flat side of the thrust runner.

7. The centrifugal pump according to claim 1, wherein:

the thrust bearing base has an end opposite the thrust face that is flush with the junction of the bore with the receptacle and which has an inner diameter less than an inner diameter of the bore in the diffuser measured at a junction of the bore with the receptacle.

8. The centrifugal pump according to claim 1, further comprising:

a second downstream impeller spaced downstream from the first mentioned downstream impeller; and a spacer sleeve surrounding the shaft, engaging a hub of the second downstream impeller and a hub of the first mentioned downstream impeller, the spacer sleeve being axially movable relative to the shaft to transmit down thrust from the second downstream impeller to the first mentioned downstream impeller.

9. The centrifugal pump according to claim 1, further comprising:

a downstream diffuser downstream from the first mentioned diffuser;

an up thrust bearing base bonded to the downstream diffuser, the up thrust bearing base having a generally concave thrust face;

an up thrust runner having a generally convex side in rotating engagement with the thrust face of the up thrust bearing base, the up thrust runner being axially movable relative to the shaft and rotatable with the shaft, the up thrust runner transmitting up thrust from the downstream impeller to the downstream diffuser; and wherein the up thrust runner and the up thrust bearing base are made of a harder material than the downstream diffuser and the downstream impeller.

10. A centrifugal pump comprising:

a rotatably driven drive shaft;

a diffuser having a bore through which the shaft passes and a generally concave receptacle at an upper end of the bore;

a thrust bearing base having a generally convex side that mates with and is bonded into the receptacle, the thrust bearing base having a generally concave thrust face opposite the convex side;

a thrust runner having a generally convex lower side in rotating engagement with the thrust face of the thrust bearing base, the thrust runner being axially movable relative to the shaft and rotatable with the shaft;

an impeller adjacent to and above the diffuser and rotated by the shaft;

a thrust sleeve surrounding and rotatable with the shaft and extending between the impeller and the thrust runner for transmitting down thrust to the thrust bearing base; and wherein the thrust sleeve, the thrust runner, and the thrust bearing base are made of a harder and more wear resistant material than the impeller and the diffuser.

11. The centrifugal pump according to claim 10, wherein the thrust sleeve, the thrust runner, and the thrust bearing base are made of tungsten carbide.

12. The centrifugal pump according to claim 10, wherein the receptacle comprising an upward facing flat shoulder, a conical surface extending upward and outward, and a cylindrical surface joining the conical surface.

13. The centrifugal pump according to claim 10, wherein the thrust bearing base has a lower side that is spaced by a gap from a hub of an adjacent impeller located below the diffuser.

14. The centrifugal pump according to claim 10, wherein the thrust runner has a flat upper side, and the thrust sleeve has a lower end that abuts the upper side of the thrust runner.

15. The centrifugal pump according to claim 10, wherein:

the thrust bearing base has a lower end with an inner diameter less than an inner diameter of the bore in the diffuser measured at a junction of the bore with the receptacle; and the lower end of the thrust bearing base is flush with the junction of the bore with the receptacle.

16. The centrifugal pump according to claim 10, further comprising:

a second impeller spaced above and adjacent to the first mentioned impeller;

a spacer sleeve surrounding the shaft engaging a hub of the second impeller and a hub of the first mentioned impeller, the spacer sleeve being axially movable relative to the shaft to transmit down thrust from the second impeller to the first mentioned impeller.

17. The centrifugal pump according to claim 10, further comprising:

a second diffuser mounted above said first mentioned diffuser;

an up thrust bearing base bonded on a lower portion of the second diffuser, the up thrust bearing base having a generally concave thrust face on a lower side;

an up thrust runner having a generally convex upper side in rotating engagement with the thrust face of the up thrust bearing base, the up thrust runner being axially movable relative to the shaft and rotatable with the shaft, the up thrust runner transmitting up thrust from the impeller to the second diffuser; and wherein the up thrust bearing base and the up thrust runner are formed of a harder material than the impeller and the second diffuser.

18. A centrifugal pump comprising:

a rotatably driven shaft;

a first diffuser having a bore through which the shaft passes, the first diffuser having a concave receptacle on an upper portion;

a down thrust bearing base having a convex side bonded in the receptacle, the down thrust bearing base having a concave thrust face;

a down thrust runner having a convex side in rotating engagement with the thrust face of the down thrust bearing base, the down thrust runner being axially movable relative to the shaft and rotatable with the shaft;

a first impeller rotated by the shaft above the first diffuser;

a thrust sleeve surrounding and rotatable with the shaft and extending between the first impeller and the down thrust runner for transmitting down thrust to the down thrust bearing base;

a second diffuser spaced above the first diffuser;

a second impeller spaced above the first impeller and in rotatable engagement with the second diffuser;

a spacer sleeve surrounding the shaft engaging a hub of the second impeller with a hub of the first impeller, the spacer sleeve being axially movable relative to the shaft to transmit down thrust from the second impeller to the first impeller; and wherein the thrust sleeve, the thrust runner, and the thrust bearing base are made of a harder material than the first and second diffusers and the first and second impellers.

19. The centrifugal pump according to claim 18, further comprising:

a third diffuser mounted above the second diffuser;

an up thrust bearing base stationarily mounted on a lower portion of the third diffuser, the up thrust bearing base having a concave thrust face; and an up thrust runner having a convex side in rotating engagement with the thrust face of the up thrust bearing base, the up thrust runner being axially movable relative to the shaft and rotatable with the shaft, the up thrust runner transmitting up thrust from the second impeller to the third diffuser.

* * * * *

UNITED STATES PATENT AND TRADEMARK OFFICE

CERTIFICATE OF CORRECTION

PATENT NO. : 8,894,350 B2
APPLICATION NO. : 12/938160
DATED : November 25, 2014
INVENTOR(S) : Christopher M. Brunner et al.

It is certified that error appears in the above-identified patent and that said Letters Patent is hereby corrected as shown below:

In the Specification,
Column 3, line 4, insert -- from -- between "upward" and "bottom"
Column 5, line 8, delete "provides" and insert -- provided --
Column 5, line 11, delete "face" and insert -- faces --

In the Claims,
Column 6, line 54, claim 12, delete "comprising" and insert -- comprises --

Signed and Sealed this
Thirtieth Day of June, 2015

Michelle K. Lee

Michelle K. Lee
*Director of the United States Patent and Trademark Office*